US009151036B2

(12) United States Patent
Hsieh

(10) Patent No.: US 9,151,036 B2
(45) Date of Patent: Oct. 6, 2015

(54) SQUARE SHAPED LIGHTWEIGHT STEEL COMPONENT WITH REINFORCED MEMBERS

(76) Inventor: Ying Chun Hsieh, Fengyuan (CN)

( * ) Notice: Subject to any disclaimer, the term of this patent is extended or adjusted under 35 U.S.C. 154(b) by 0 days.

(21) Appl. No.: 13/807,179

(22) PCT Filed: Jun. 17, 2011

(86) PCT No.: PCT/CN2011/075874

§ 371 (c)(1),
(2), (4) Date: Dec. 27, 2012

(87) PCT Pub. No.: WO2012/000391

PCT Pub. Date: Jan. 5, 2012

(65) Prior Publication Data

US 2013/0097961 A1 Apr. 25, 2013

(30) Foreign Application Priority Data

Jun. 30, 2010 (CN) ..... 2010 1 0216616

(51) Int. Cl.

| | |
|---|---|
| ***E04B 1/19*** | (2006.01) |
| ***E04C 5/18*** | (2006.01) |
| ***E04B 1/18*** | (2006.01) |
| ***E04C 3/07*** | (2006.01) |
| ***E04B 1/30*** | (2006.01) |
| *E04C 3/04* | (2006.01) |

(52) U.S. Cl.

CPC . *E04B 1/185* (2013.01); *E04B 1/30* (2013.01); *E04C 3/07* (2013.01); *E04C 2003/0421* (2013.01); *E04C 2003/0465* (2013.01); *E04C 2003/0473* (2013.01)

(58) Field of Classification Search

CPC ..... E04C 3/07; E04C 3/32; E04C 2003/0413; E04C 2003/043; E04C 2003/0465; E04C 2003/0473

USPC ..... 52/653.1, 653.2, 654.1, 656.9, 685, 52/696, 831, 834, 843, 848

See application file for complete search history.

(56) References Cited

U.S. PATENT DOCUMENTS

| | | | | |
|---|---|---|---|---|
| 2,004,907 | A * | 6/1935 | Crawford et al. | 52/651.09 |
| 2,731,824 | A * | 1/1956 | Hadley | 52/252 |
| 3,300,940 | A * | 1/1967 | Golasz | 52/843 |
| 3,890,697 | A * | 6/1975 | Horioka | 29/525.02 |
| 5,157,883 | A * | 10/1992 | Meyer | 52/357 |
| 5,992,125 | A * | 11/1999 | Hardy | 14/75 |
| 6,802,170 | B2 * | 10/2004 | Davis | 52/843 |
| 6,971,690 | B2 * | 12/2005 | Evans et al. | 293/102 |
| 2004/0045237 | A1 * | 3/2004 | Coombs et al. | 52/309.11 |
| 2005/0241261 | A1 * | 11/2005 | Martinez-Cepeda | 52/737.6 |
| 2008/0041555 | A1 * | 2/2008 | Zurewich et al. | 164/488 |

FOREIGN PATENT DOCUMENTS

| | | | |
|---|---|---|---|
| CN | 1702258 | | 11/2005 |
| CN | 20173844 | | 2/2011 |
| CN | 202194250 U | * | 4/2012 |
| DE | 2701396 A | * | 7/1978 |
| WO | WO9730235 | | 8/1997 |

* cited by examiner

*Primary Examiner* — Jeanette E Chapman
(74) *Attorney, Agent, or Firm* — McHale & Slavin, P.A.

(57) ABSTRACT

A square shaped lightweight steel component with reinforced members includes a main body structure (1) and reinforced members (2). The main body structure (1) is a square steel tube integrally molded by a steel plate with certain thickness. One side of the square steel tube is provided with an opening. Angular curled edges (5) are respectively set on two sides of the opening. The reinforced members (2) are fixedly connected with the side of the main body structure (1) having the opening and installed with an interval therebetween.

5 Claims, 3 Drawing Sheets

SQUARE SHAPED LIGHTWEIGHT STEEL COMPONENT WITH REINFORCED MEMBERS

CROSS REFERENCE TO RELATED APPLICATIONS

This is a national stage filing in accordance with 35 U.S.C. §371 of PCT/CN2011/075874, filed Jun. 17, 2011, which claims the benefit of the priority of Chinese Patent Application No. 201010216616.4, filed Jun. 30, 2010, the contents of each are incorporated herein by reference.

TECHNICAL FIELD OF THE INVENTION

The invention relates to a steel member used in the construction field, particularly to a square-shaped lightweight steel member with reinforced components used in the construction field.

TECHNICAL BACKGROUND OF THE INVENTION

A square-shaped steel member, which is used in the lightweight steel field, generally adopts a square-shaped steel tube or two C-shaped steel members welded together. Ordinary tacking holes for bolting with other members in present square-shaped steel tube could only be made with a driller or flame and hence cannot be punched and processed with a press machine, thereby causing the cost to be high. The present square-shaped steel tube cannot be engaged with other member with a friction-type high-tension bolt, thus greatly reducing bearing capacity of a joint. As shown in FIG. 1, the figure shows the combination of present steel tube member used in the prior art. As to the member, the square-shaped steel, which is molded through a welding method, is used and taken as the main body structure 7. When used, the member is connected with a C-shaped steel 6 by a common bolt. Therefore, the square-shaped steel will be deformed because of too big shearing force. For corrosion resisting, the square-shaped steel tube is generally coated after being processed, which causes the cost to be high. If the tube was welted together by galvanized C-shaped steel, the process of welting will hurt the coating of corrosion resisting layer.

Therefore, the abovementioned present square-shaped steel member still has some shortcoming in actual application, which is rather urgent to implement further breakthrough improvement. In order to solve the present problems of the present lightweight square-shaped steel member, the inventor, based on the rich and practical experience in the design and manufacture of such products for many years as well as matching the applications of theories, actively carries out research and innovation, so as to create a novel square-shaped lightweight steel member with reinforced components which may improve the general present square-shaped lightweight steel member and facilitates it to have further practicability. Through continuous research, design, repeated trials and improvement, the inventor finally creates the invention which is indeed useful and practical.

SUMMARY OF THE INVENTION

The invention aims at overcoming the defects of the present square-shaped lightweight steel and providing a novel square-shaped lightweight steel member with reinforced components. To solve the technical problems facilitates the structure to be more optimized and be more convenient when used on site, the member will be stronger in compression and buckling resistance, and hence become more practical.

The other object of the invention is to provide square-shaped lightweight steel member with reinforced components. The solution of technical problems allows the combination with other members more convenient and hence be more practical.

The objects and the technical problems to be solved of the invention are achieved through the following technical proposal: A square-shaped lightweight steel member with reinforced components according to the invention comprises: a main body structure which is a square-shaped steel tube, it was integrally rolled by steel sheet with certain thickness, and one side of which is provided with an opening, two sides of opening have angular curled edges, and the reinforced components, which is fixedly connected with the side of opening and installed with an interval therebetween.

The objects and the technical problems to be solved of the invention may further be achieved through the following technical proposals: As to the abovementioned square-shaped lightweight steel member with reinforced components, wherein the steel sheet is a coated steel sheet.

As to the abovementioned square-shaped lightweight steel member with reinforced components, wherein the angular curled edges of two sides of the opening have certain interval therebetween, which is as wide as about one third of the width of the main body structure.

As to the abovementioned square-shaped lightweight steel member with reinforced components, wherein the internal space of the square-shaped steel tube integrally formed is filled with concrete or cement mortar.

As to the abovementioned square-shaped lightweight steel member with reinforced components, which is bent or rolled by steel sheet integrally.

As to the abovementioned square-shaped lightweight steel member with reinforced components, wherein the reinforced components (connectors) are steel sheet, and the connectors are fixed on an opening side of the main body structure by bolts, rivets or welding.

As to the abovementioned square-shaped lightweight steel member with reinforced components, wherein pre-punched hole on the side surface of the light-weight steel provide connecting with reinforced components and other light-weight steel members by bolt or rivet.

Compared with the prior art, the invention has obvious advantages and beneficial effects. Based on the abovementioned technical proposals, the square-shaped lightweight steel member with reinforced components at least has the following advantages:

1. The invention provides a square-shaped lightweight steel member with reinforced components. Its preferred embodiment is to adopt a galvanized steel sheet to form square-shaped lightweight steel members that are free of welding seam, and hence be beneficial for the corrosion resisting.

2. The invention provides the square-shaped lightweight steel member with reinforced components. One side of the lightweight steel member is provided with an opening with angular curled edges. This structure not only is conducive to strengthening the lateral confinement of the materials at the two wings of the opening and beneficial for enhancing the resistance of stress and moment in the square-shaped lightweight steel member, but also beneficial for enhancing the connection between other member and the square-shaped main structure (as shown in FIG. 2).

3. The invention provides the square-shaped lightweight steel member with reinforced components. One side of the lightweight steel member provided with an opening is fixed with reinforced components in a certain interval. The reinforced components is made of the steel sheet or other material with good strength and toughness, thus being beneficial for enhancing the moment resistance, the stress resistance and the buckling resistance of the square-shaped lightweight steel member.

4. The invention provides the square-shaped lightweight steel member with reinforced components. Filling the tube with concrete or cement mortar may be determined by structure analysis when structure is installed, thus it will have wider application and occasions.

5. The invention provides the square-shaped lightweight steel member with reinforced components. The steel member may be locked and connected with other members through pre-punched hole (such as a bolt hole) on the other side surface of the square-shaped main body structure as well as a beam or other member in a lightweight steel construction by a bolt (as shown in FIG. 4).

6. The invention provides the square-shaped lightweight steel member with reinforced components. When the member is punched and processed, the opening on one side may let a mould reach an arbitrary place of the square-shaped lightweight steel member, thus facilitating a press machine to be operated smoothly.

7. The invention provides the square-shaped lightweight steel member with reinforced components. When it is engaged with a beam or other member, an opening at its one side is beneficial for a tool and a bolt to be operated and screwed (as shown in FIG. 4).

In summary, as to the particular square-shaped lightweight steel member with reinforced components of the invention, it has above advantages and practical value, is indeed innovative because there are not similar designs and publications in similar products, has greater improvement in its product structure or functions, has relatively big advancement in technology, and has easy use and practical effects. Compared with the present square-shaped lightweight steel member, it has great efficacy, thus becoming more practical, having wider value in use in its industry. Therefore, it is indeed a novel, advanced and practical design.

The above description is only an overview of the technical solution of the invention. In order that the technical means of the invention may be better understood and implemented in accordance with the contents of the specification, the invention is described in details through the following preferred embodiments and reference to the drawings.

DRAWINGS OF THE INVENTION

1: Main Body Structure; 2; Reinforced components; 3: Concrete 4: Friction-type High-Tension Bolt; 5: Angular Curled Edge; 6: C-Shaped Steel 7: Closed Main Body Structure; 8: Common Bolt

EMBODIMENTS OF THE INVENTION

Figure 1:
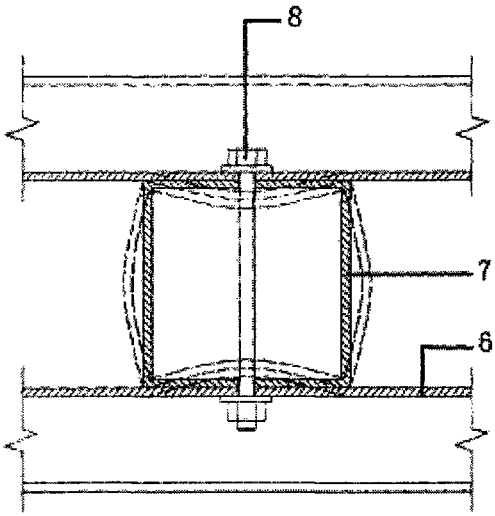
FIG. 1 shows a structure of a square-shaped lightweight steel member used in the prior art and a schematic diagram when the member and a C-shaped steel are used together.
Figure 2:
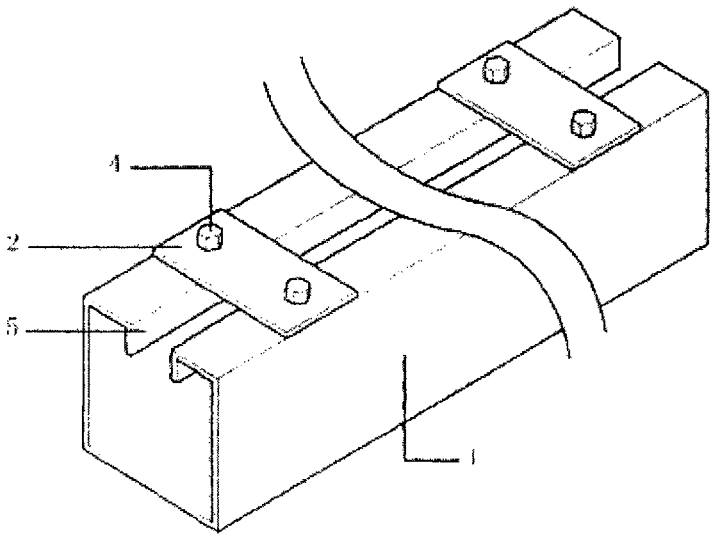
FIG. 2 is a schematic diagram of a square-shaped lightweight steel member with reinforced components proposed in a preferred embodiment of the invention.

To further illustrate the technological means and effectiveness of the invention taken to achieve a predetermined purpose of the invention, with the combination with drawings and preferred embodiments, the specific characteristics and efficacy of the square-shaped lightweight steel member with reinforced components are proposed in details according to the invention in the following:

As shown in FIG. 2, a square-shaped lightweight steel member with reinforced components mainly comprises: a main body structure which is a square-shaped steel tube integrally formed by a steel sheet with certain thickness, and one side of which is provided with an opening whose two sides are angular curled edges, and the reinforced components which is fixedly connected with the side of the main body structure having the opening and installed with an interval therebetween wherein the angular curled edges 5 of two the sides of the opening have certain interval therebetween, which is preferably as wide as about one third of the width of the main body structure 1. The angle of the angular curled edges may be an arbitrary angle and preferably a right angle.

Figure 3:
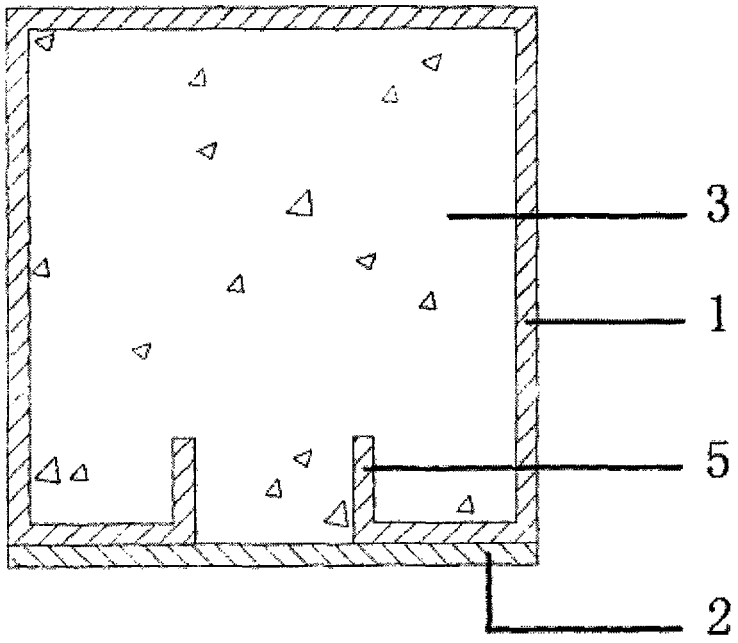
FIG. 3 is a structure section diagram of a square-shaped lightweight steel member with reinforced components proposed in another embodiment of the invention.

As shown in FIG. 3, as to another embodiment of the square-shaped lightweight steel member with reinforced components according to the invention, the difference between the embodiment in FIG. 3 and that in FIG. 2 is that: the main body structure 1 of the squares-shaped lightweight steel member is filled with concrete 3 of a filling material which is used to improve the strength of the square-shaped lightweight steel member. The filling material also may be other materials with the similar functions, such as cement mortar.

Figure 4:
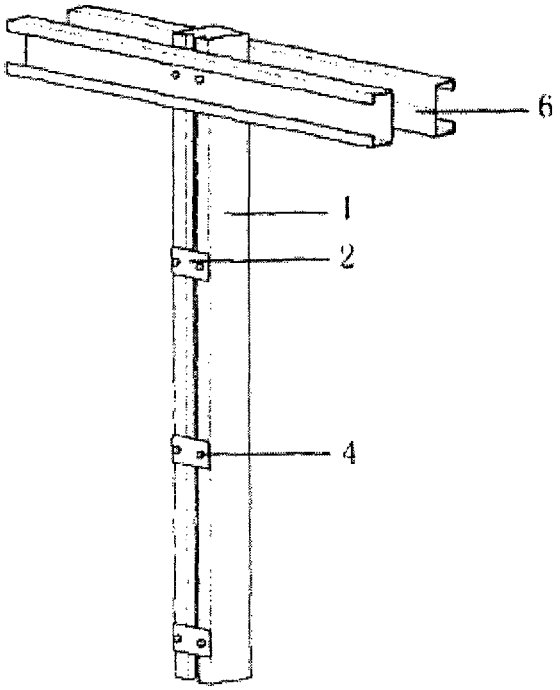
FIG. 4 is a schematic diagram when a square-shaped lightweight steel member with reinforced components is used in the combination with a C-shaped steel proposed in the invention.
Figure 5:
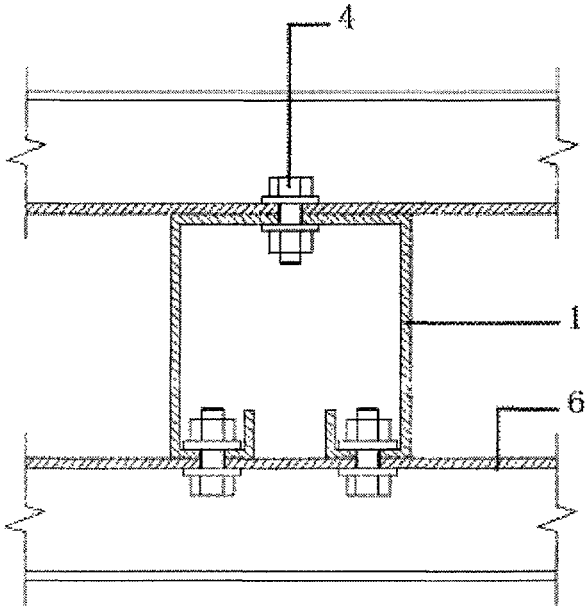
FIG. 5 is a section diagram when a square-shaped lightweight steel member with reinforced components is used in the combination with a C-shaped steel proposed in the invention. In the figures.

Please refer to FIG. 4. FIG. 4 is a schematic diagram when a square-shaped lightweight steel member with reinforced components is used in the combination with a C-shaped steel proposed in the invention. Please refer to FIG. 5. FIG. 5 is a section diagram when a square-shaped lightweight steel member with reinforced components is used in the combination with a C-shaped steel proposed in the invention. As shown in the above figures, When used, a friction-type high-tension bolt 4, through a punched hole (not shown in figures) in the square-shaped lightweight steel member and the C-shaped steel 6, is connected with two sides of the main body structure 1 respectively, thus avoiding deformation of the square-shaped steel because of too great shearing force in the prior art.

Above description are only preferred embodiments but not to limit the invention in any form. Although the invention is disclosed with the preferred embodiments as above, the embodiments are not to limit the invention. Any skilled in the art may utilize the above disclosed methods and technical contents to implement equivalent embodiments with some alterations or modifications while being without departing from the scope of the technical proposal of the invention. Based on the technical essences of the invention, any simple alteration, equivalent changes and modifications in the above embodiments are all within the scope of the technical proposal of the invention.

The invention claimed is:

1. A building system formed from a square-shaped lightweight steel column member with reinforced components, the system comprising:

a main body structure forming the column member for vertical installation, said main body structure is a square-shaped steel tube rolled from a steel sheet with certain thickness defining an interior space sized for receipt of concrete or cement mortar, said main body structure having a front wall, a back wall, and two opposing wall surfaces, a top end and a bottom end, said front wall of said square-shaped steel tube is provided with an opening having two sides extending the length of the main body structure, said opening having two angular curled edges spaced apart as wide as about one third the width of the main body structure, the width of said opening is sized to allow a tool to pass through said opening into said interior space of said main body structure, said two angular curled edges are substantially perpendicular to the two sides of the opening;

at least one reinforced component, which is fixedly connected to said front of the main body structure and installed between said top end and said bottom end;

each of said sides of the opening contains at least one pre-punched hole for connection of said at least one reinforced component, said at least one reinforced bridging said opening; and said interior space is filled with concrete or cement mortar, whereby said at least one reinforced component prevents said main body from expanding as said concrete or cement mortar fills said interior, said main body and at least one reinforced component forming the shape of, and being part of, said square-shaped lightweight steel column member.

2. The system formed from a square-shaped lightweight steel column member with reinforced components according to claim 1, wherein the steel sheet is a galvanized steel sheet.

3. The system for a square-shaped lightweight steel member with reinforced components according to claim 1, wherein the steel sheet is integrally formed by bending or rolling said galvanized steel sheet.

4. The system for a square-shaped lightweight steel column member with reinforced components according to claim 1, wherein the reinforced components are the steel sheet which is fixedly connected with the main body structure through means of bolts, rivets or welding.

5. The system for a square-shaped lightweight steel column member with reinforced components according to claim 4, wherein the bolt is a friction-type high-tension bolt.

* * * * *